US010186805B2

(12) United States Patent
DeWitt et al.

(10) Patent No.: US 10,186,805 B2
(45) Date of Patent: Jan. 22, 2019

(54) ELECTRICAL CONNECTOR WITH LOCKING MECHANISM

(71) Applicant: Carlisle Interconnect Technologies, Inc., Kent, WA (US)

(72) Inventors: William James DeWitt, Camarillo, CA (US); Sinisa Straser, Rancho Palos Verdes, CA (US)

(73) Assignee: CARLISLE INTERCONNECT TECHNOLOGIES, INC., Kent, WA (US)

( * ) Notice: Subject to any disclaimer, the term of this patent is extended or adjusted under 35 U.S.C. 154(b) by 0 days.

(21) Appl. No.: 15/815,459

(22) Filed: Nov. 16, 2017

(65) Prior Publication Data

US 2018/0138633 A1 May 17, 2018

Related U.S. Application Data

(60) Provisional application No. 62/423,397, filed on Nov. 17, 2016.

(51) Int. Cl.

| | |
|---|---|
| ***H01R 13/33*** | (2006.01) |
| ***H01R 13/627*** | (2006.01) |
| ***H01R 13/52*** | (2006.01) |
| ***H01R 13/641*** | (2006.01) |
| ***H01R 13/187*** | (2006.01) |

(52) U.S. Cl.

CPC ..... *H01R 13/6277* (2013.01); *H01R 13/187* (2013.01); *H01R 13/5219* (2013.01); *H01R 13/641* (2013.01)

(58) Field of Classification Search

CPC ..... H01R 4/4863
USPC ..... 439/840, 841, 843, 846
See application file for complete search history.

(56) References Cited

U.S. PATENT DOCUMENTS

| | | | | |
|---|---|---|---|---|
| 659,523 | A | 10/1900 | Furbish | |
| 8,052,459 | B2 | 11/2011 | Smith et al. | |
| 8,308,167 | B2 | 11/2012 | Balsells et al. | |
| 8,851,939 | B2 * | 10/2014 | Bazenas | F16F 1/045 439/840 |

(Continued)

OTHER PUBLICATIONS

International Searching Authority Russian Patent Office, International Search Report and Written Opinion, PCT/US2017/062400, dated Feb. 14, 2018, 9 pp.

*Primary Examiner* — Phuong Dinh
(74) *Attorney, Agent, or Firm* — Stoel Rives LLP

(57) ABSTRACT

An electrical connector system includes mating pin and socket connectors each designed for improving the mechanical locking capabilities of the electrical connector system. A first connector includes a pin contact having a head portion with grooves formed thereon, and a second connector includes a cavity dimensioned for receiving the pin contact. A pair of channels are formed along an interior wall of the contact-receiving cavity, with a coiled spring seated within each of the channels. When the connectors are mated, one or both of the coiled springs engages one of the grooves of the head portion of the pin contact to latch the first and second connectors together in a locked configuration. The connector system may further include a removable collar that allows the pin to advance further into the contact-receiving cavity to urge the coiled springs into secondary grooves for facilitating decoupling of the connectors.

20 Claims, 5 Drawing Sheets

(56) References Cited

U.S. PATENT DOCUMENTS

| | | | | |
|---|---|---|---|---|
| 9,011,169 | B2 * | 4/2015 | Russell | H01R 13/648 439/271 |
| 9,677,587 | B2 * | 6/2017 | Changsrivong | F16B 17/00 |
| 2010/0311266 | A1 | 12/2010 | Dilmaghanian et al. | |
| 2011/0124245 | A1 * | 5/2011 | Fujita | H01R 13/17 439/840 |
| 2013/0149029 | A1 | 6/2013 | Changsrivong et al. | |
| 2013/0149031 | A1 | 6/2013 | Changsrivong et al. | |
| 2013/0288501 | A1 | 10/2013 | Russell et al. | |

* cited by examiner

ELECTRICAL CONNECTOR WITH LOCKING MECHANISM

RELATED APPLICATION DATA

This application is a nonprovisional of and claims priority under 35 U.S.C. § 119(e) to U.S. Provisional Application No. 62/423,397, filed on Nov. 17, 2016, the disclosure of which is incorporated herein by reference in its entirety.

TECHNICAL FIELD

The field of this disclosure relates generally to electrical connector systems, and in particular, to such systems where the electrical connectors include a locking mechanism for firmly locking together a mated pair of electrical connectors, and wherein the locking mechanism is releasable for unlocking and unmating the pair of the electrical connectors, as desired.

BACKGROUND

In general, an electrical connector is an electro-mechanical device used to join electrical terminations and create an electrical circuit. Typically, electrical connectors consist of male-ended portions (e.g., plugs) and female-ended portions (e.g., sockets or jacks) that are connected sufficiently tightly together to create a solid electrical connection and complete the electrical circuit. In some electrical devices, the connection of these male-ended and female-ended portions may be temporary, such as for portable equipment where the connectors are designed to be frequently disconnected from one other. In other arrangements, the connectors may require a tool for assembly and removal, or may be designed to serve as a permanent electrical joint between two wires or devices.

In some designs, primarily for commercial or industrial settings, electrical connectors may include locking mechanisms to prevent inadvertent disconnection of the male and female components and/or to alleviate poor environmental sealing. Such locking mechanisms may include a variety of locking levers, screw locking mechanisms, and toggle or bayonet locking mechanisms. Typically, such locking mechanisms are designed not only to retain the connectors together in an engaged arrangement, but also to protect the electrical connectors during use in various environmental conditions that may expose the connectors to physical shock and vibration, water spray or excessive moisture, and/or dust. Accordingly, such locking mechanisms help ensure that the electrical connectors are properly sealed to maintain the integrity of the electrical connection and the overall electrical system.

In aerospace and other applications, electrical connectors are subjected to a variety of harsh environmental conditions, such as the presence of moisture, vibrations and mechanical shock, and pressure changes, all of which can detrimentally impact an electrical connector's performance. Because degraded performance of an electrical connector adversely affects the ability of a system to suitably transfer power, the present inventor has recognized a need for a robust electrical connector system capable of facilitating appropriate power transfer in aerospace and other suitable applications, such as aircraft electronic systems with high performance criteria. In addition, the present inventor has recognized a need for such an improved electrical connector with a streamlined locking mechanism that is not only secure to prevent inadvertent decoupling of the male and female components, but also easily releasable, when desired, to disassemble the electrical connector, such as for repair and rework. Additional aspects and advantages will be apparent from the following detailed description of preferred embodiments, which proceeds with reference to the accompanying drawings.

DETAILED DESCRIPTION OF EXAMPLE EMBODIMENTS

With reference to the drawings, this section describes particular embodiments of an electrical connector system and its detailed construction and operation. Throughout the specification, reference to "one embodiment," "an embodiment," or "some embodiments" means that a particular described feature, structure, or characteristic may be included in at least one embodiment of the electrical connector system or of the electrical connector components being discussed. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like.

In the following description, particular components of the electrical connector system and of the electrical connectors comprising that system are described in detail. It should be understood that in some instances, well-known structures, materials, or operations are not shown or not described in detail to avoid obscuring pertinent aspects of the embodiments. In addition, although some embodiments illustrated and/or described herein may reference electrical connectors having a specific arrangement or number of pin and socket connectors (and contacts), the scope of the written disclosure may encompass other embodiments with differently configured components adapted to house more or fewer pin connectors.

The following describes example embodiments of an electrical connector system that may be used to connect cable segments together to improve power transfer and performance. While reference in the following description may relate to the electrical connector system being used in the aerospace industry, such as for commercial aircraft, other suitable uses of the electrical connector system described herein are also contemplated, such as use in military applications, ground power, and in the mining, gas, and oil industries. Accordingly, the scope of the written disclosure is not intended to be limited to the environments of use specifically described herein.

Figure 2:
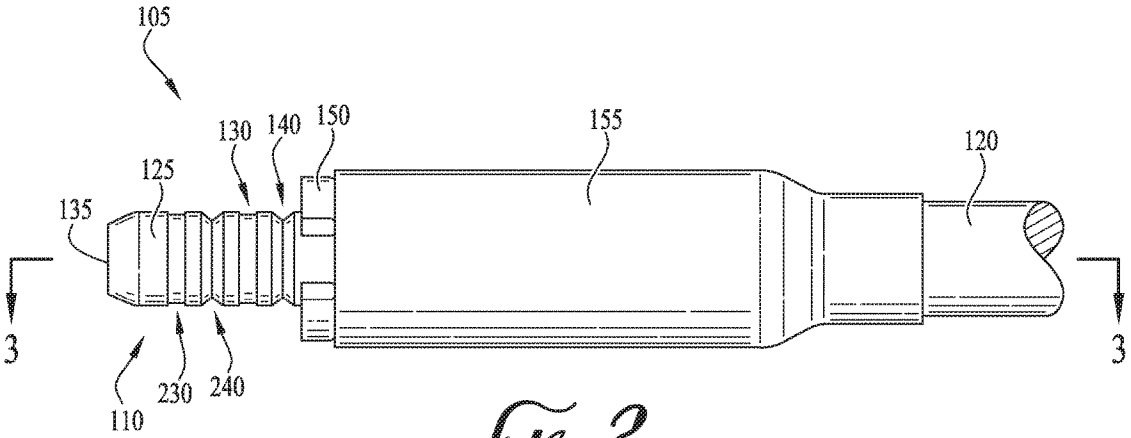
FIG. 2 is a side view of an embodiment of a pin contact connector of the electrical connector of FIG. 1.
Figure 3:
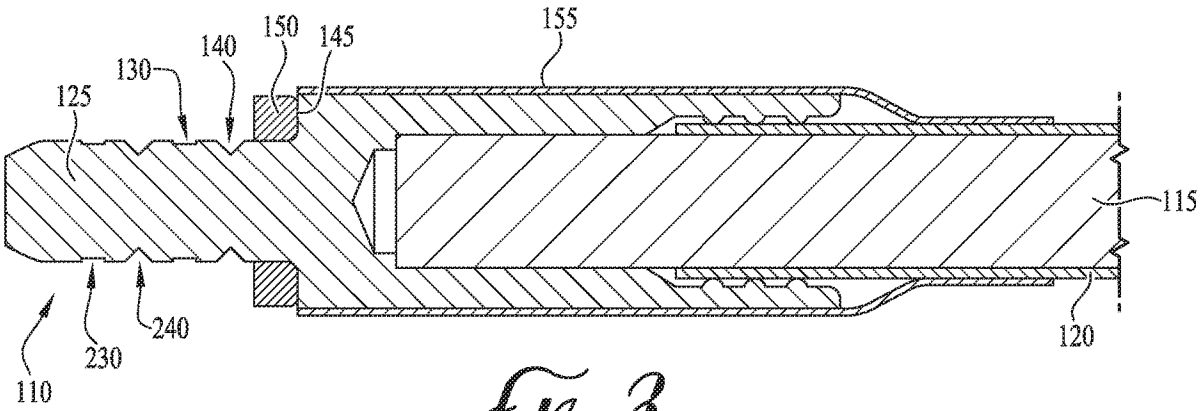
FIG. 3 is a cross-section view of the pin contact connector of FIG. 2.
Figure 4:
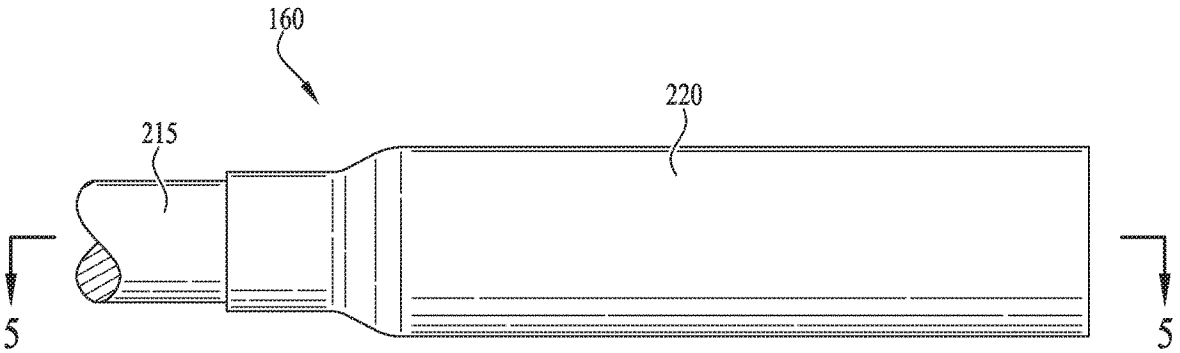
FIG. 4 is a side view of an embodiment of a socket contact connector of the electrical connector of FIG. 1.
Figure 5:
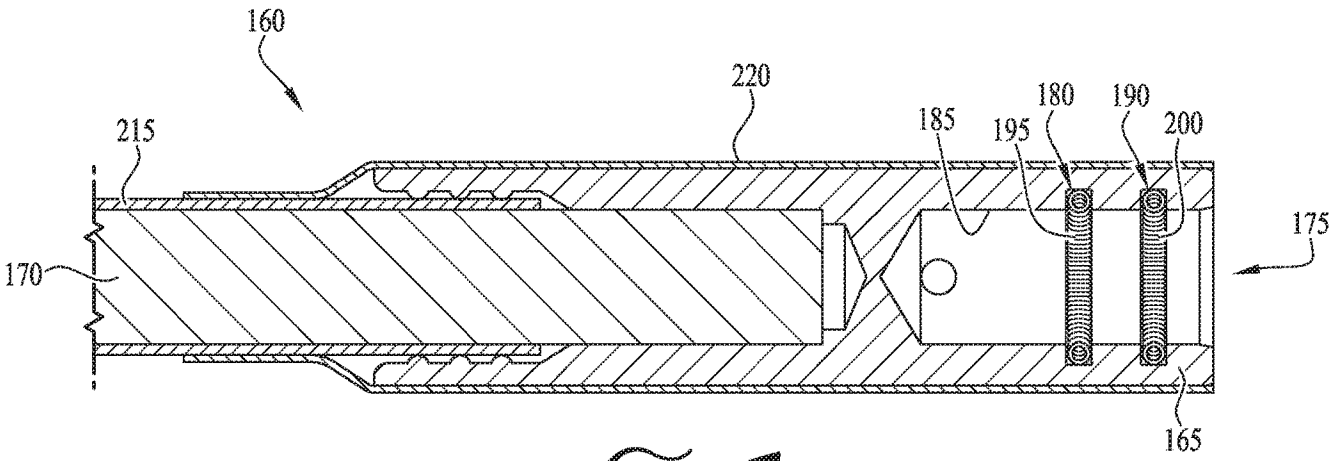
FIG. 5 is a cross-section view of the socket contact connector of FIG. 4.

With general reference to FIGS. 1-9, the following disclosure relates to an electrical connector 100 including mating connector ends with a pin contact connector 105 (see FIGS. 2-3) and a socket contact connector 160 (see FIGS. 4-5). As is further described in detail below, the electrical connector 100 includes a locking mechanism operable to tightly secure the pin and socket contact connectors 105, 160 to one another in a mated configuration. In addition, the locking mechanism is releasable to facilitate decoupling of the contact connectors 105, 160 when desired, such as for wire repair and maintenance purposes. Additional details relating specifically to the connectors 105, 160 and to the locking mechanism are further described in detail below.

Figure 1:
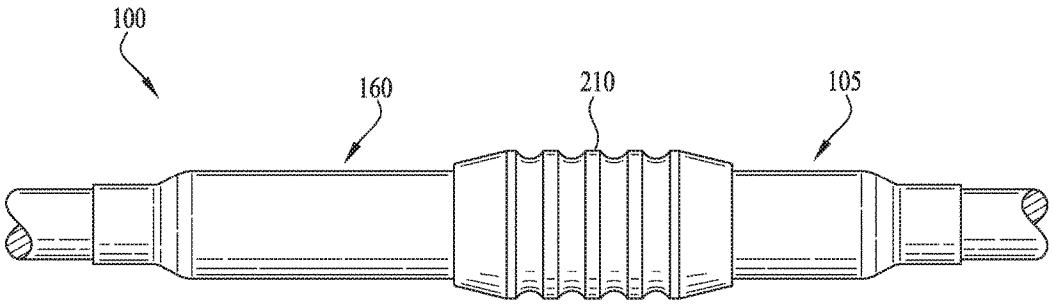
FIG. 1 is a side view of an embodiment of an electrical connector in a mated and locked configuration.

FIG. 1 is a view of the electrical connector 100 in a mated and locked configuration, the electrical connector 100 including a pin contact connector 105 and a socket contact connector 160. The following focuses on details of the pin contact connector 105, with details of the socket contact connector 160 described thereafter with particular reference to FIGS. 4-5.

FIGS. 2-3 illustrate views of an embodiment of the pin contact connector 105 of the electrical connector 100. With collective reference to FIGS. 2-3, the pin contact connector 105 includes a pin contact 110 that terminates wires 115. The pin contact connector 105 may be made of any suitable conductive metal or metal alloy such as copper, aluminum, or nickel (or nickel-plated material). The wires 115 may include a jacket 120 encircling or surrounding the wires 115 to insulate and protect the wires 115 from the environment during use. The pin contact 110 includes a head portion 125 with a first locking groove 130 and a second locking groove 230 formed thereon, the locking grooves 130, 230 offset from one another. In some embodiments, the locking grooves 130, 230 may be recessed into the head portion 125 such that the locking grooves 130, 230 each have a generally smaller circumference as compared to the main body of the pin contact 125, the locking grooves 130, 230 each extending around a circumference of the head portion 125 set apart from an end 135 of the head portion 125. The pin contact 110 further includes a first unlocking groove 140 and a second unlocking groove 240 formed thereon and extending around a circumference of the head portion 125, where the unlocking grooves 140, 240 are offset from one another. Preferably, the locking grooves 130, 230 are recessed to a depth shallower than the depth of the unlocking grooves 140, 240 as illustrated in FIG. 3. As illustrated in FIG. 2, in one embodiment, the locking grooves 130, 230 and the unlocking grooves 140, 240 are arranged in an alternating relationship, with the second locking groove 230 formed adjacent the end 135 of the head portion 125, followed by the second unlocking groove 240, the first locking groove 130, and the first unlocking groove 140 arranged furthest from the end 135. In some embodiments, the unlocking groove 140 may include a marking or other indicator, such as a colored band or region, to notify an operator or user whether the pin and socket connectors 105, 160 are mated properly. Additional information relating to the grooves 130, 140, 230, 240 and their operability in locking and unlocking the electrical connector 100 is further described in detail below.

With particular reference to FIG. 3, the pin contact connector 105 may include a shoulder portion 145 against which is seated a collar 150. The collar 150 may be a generally C-shaped collar that fits around the circumference of the pin contact connector 105. As is further described in detail below, in one embodiment, the collar 150 is removable to transition the electrical connector 100 from a locked configuration to an unlocked configuration to allow for decoupling of the pin and socket connectors 105, 160 as desired. The pin contact connector 105 is encircled by heat shrink tubing 155 for improved insulation, abrasion resistance, and environmental protection. In some embodiments, the pin contact connector 105 may alternatively not include a collar 150 as further described in detail below.

FIGS. 4-5 illustrate views of an embodiment of the socket contact connector 160 of the electrical connector 100. With general reference to FIGS. 4-5, the socket contact connector 160 includes a socket contact 165 that terminates wires 170. The socket contact 165 may be made of any suitable conductive metal or metal alloy, such as copper, aluminum, or nickel (or nickel-plated material). The wires 170 may include a jacket 215 encircling or surrounding the wires 170 to insulate and protect the wires 170 from the environment during use. The socket contact 165 includes an open end 175 with corresponding dimensions to receive and accommodate the head portion 125 of the pin contact connector 105. The socket contact 165 includes a first channel 180 formed around a circumference of an interior wall 185 of the socket contact 165. The socket contact 165 further includes a second channel 190 formed around a circumference of the interior wall 185 at a second position offset from the first position, where the second position is adjacent the open end 175 of the socket contact connector 160. In some embodiments, the channels 180, 190 are formed at relatively equal depths relative to the interior wall 185 and have relatively equal widths.

With particular reference to FIG. 5, a first spring 195 is seated in the first channel 180, the spring 195 having a coiled configuration and being operable to transfer electrical current between the socket contact 165 and the pin contact 110 when the head portion 125 of the pin contact connector 105 is inserted into the socket contact 165 and the connectors 105, 160 are mated. When the connectors 105, 160 are mated, a portion of the spring 195 extends outwardly from the first channel 180 and contacts the head portion 125 of the pin contact connector 105, thereby creating a frictional force between the components that helps compensate for a potential misalignment of the contact connectors 105, 160 that may be caused by a variance in tolerance between the contact surfaces. In other words, the spring 195 helps address the backlash or play between the mechanical connection of the head portion 125 of the pin contact connector 105 and the socket contact 165 of the socket contact connector 160.

In addition, the second channel 190 houses a second spring 200 made of a conductive material that may be the same as or similar to the spring 195. Like the first spring 195, the second spring 200 is operable to transfer electrical current between the socket contact 165 and the pin contact 110 when the connectors 105, 160 are mated. The socket contact connector 160 is encircled by heat shrink tubing 220 for improved insulation, abrasion resistance, and environmental protection.

In some embodiments, the first and second springs 195, 200 may both be obround rings that are wound in opposite directions relative to one another. For example, the first spring 195 may be wound in a left-hand direction, while the second spring 200 may be wound in a right-hand direction (or vice versa). In addition, while in some embodiments, the springs 195, 200 may be made of the same material as mentioned previously, in other embodiments, the springs 195, 200 may be made of different materials. For example, in one embodiment, the first spring 195 may be made of a copper material, while the second spring 200 may be made of a stainless steel material (or vice versa). In such embodiments, the copper spring 195 provides optimum thermal and electrical conductivity characteristics, while the stainless steel spring 200 provides a high shear strength and better mechanical locking performance in high-temperature conditions. Accordingly, in this configuration, the electrical connector 100 incorporates both improved conductivity and performance in high-temperature conditions, as opposed to an electrical connector 100 where both springs 195, 200 are made of copper or stainless steel.

Figure 6:
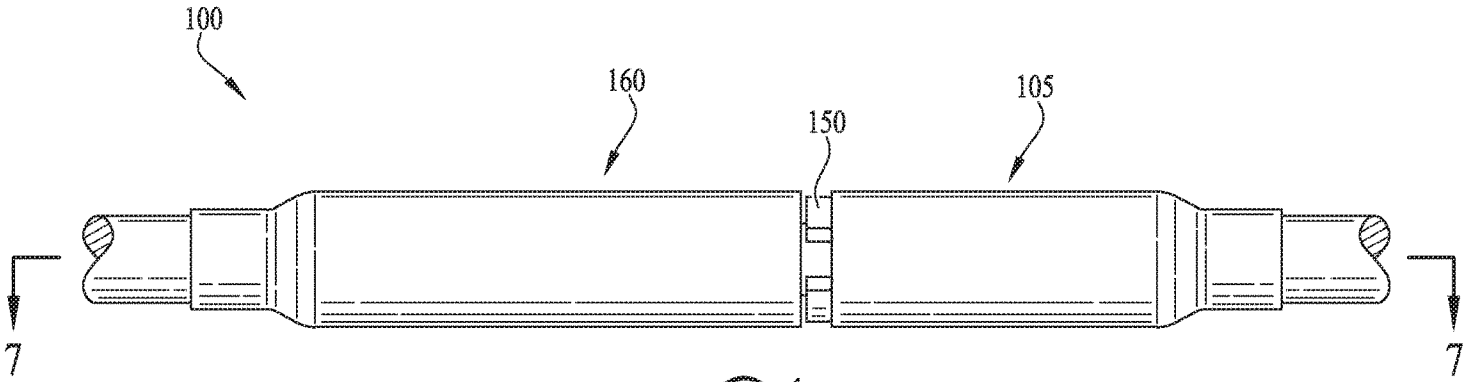
FIG. 6 is a side view of the electrical connector of FIG. 1 in a mated and locked configuration, with the sealing grommet removed to illustrate additional components of the electrical connector.
Figure 7:
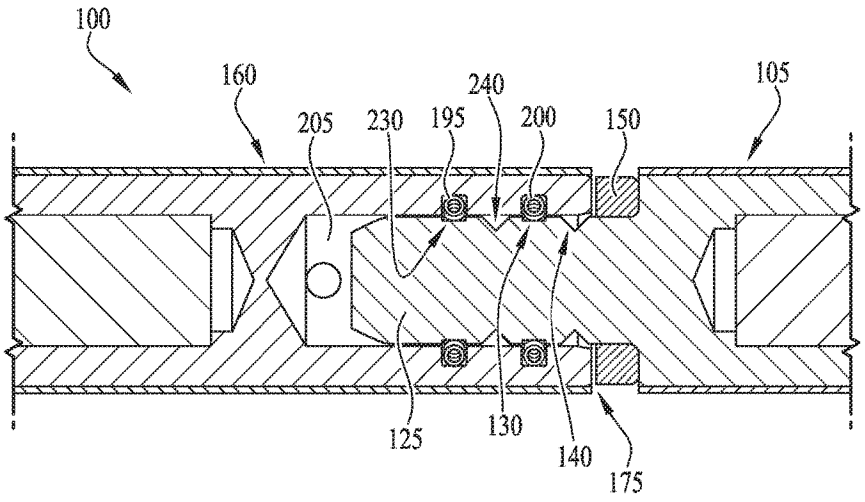
FIG. 7 is an enlarged cross-section view of a portion of the electrical connector of FIG. 6.

FIG. 6 illustrates a view of the electrical connector 100 in a mated and locked configuration, and FIG. 7 illustrates a cross-section view of a portion of the electrical connector 100 of FIG. 6. With collective reference to FIGS. 6 and 7, the following section describes an example assembly process of the electrical connector 100 in accordance with one embodiment. It should be understood that the steps described herein are meant to describe one of various potential processes for assembling the electrical connector 100. Accordingly, the following written description does not intend to be limiting with respect to the assembly process of the electrical connector 100.

With particular reference to FIG. 7, in an example assembly process, the pin contact connector 105 is advanced toward the open end 175 of the socket contact connector 160, with the head portion 125 inserted through the open end 175. The connectors 105, 160 are moved toward one another until the head portion 125 of the pin contact connector 105 extends through the open end 175 and is seated within a cavity 205 of the socket contact 165. As the head portion 125 advances into the cavity 205, the springs 195,200 each rotate in a clockwise direction within their respective channels 180, 190.

As the head portion 125 is advanced further into the cavity 205, the springs 195, 200 continue rotating within their respective channels 180, 190. When the head portion 125 advances into the socket contact 165 so that the spring 200 encounters the first locking groove 130 formed on the head portion 125 of the pin contact connector 105, the spring 200 is not yet sufficiently coiled within the channel 190 to fully lock the pin contact connector 105 within the cavity 205 and prevent further movement. As the pin contact connector 105 continues to advance within the cavity 205, the springs 195, 200 continue rotating until the springs 195, 200 encounter the first and second grooves 230, 130, respectively as illustrated in FIG. 7. At this point, the springs 195, 200 are each sufficiently coiled within their respective channels 180, 190 and compressed such that they sit against the locking grooves 230, 130 and collectively resist counter-clockwise rotation within both the channels 180, 190 and the locking grooves 130, 230 thereby effectively locking the pin contact connector 105 and socket contact connector 160 in position and preventing decoupling. In addition, since the springs 195, 200 are wound in opposite directions relative to one another, they further resist decoupling when rotational forces are applied to the connectors 105, 160.

When the connectors 105, 160 are properly mated, the colored band (or other indicator) on the unlocking groove 140 is not visible. In other words, the unlocking groove 140 is seated sufficiently far into the socket contact 165 such that the indicator is not visible. In some embodiments, a collar 150 may be incorporated and seated against the shoulder 145 prior to mating the connectors 105, 160. In this configuration, the collar 150 creates a hard stop that prevents the head portion 125 of the pin contact connector 105 from being inserted too far into the socket contact 165 during installation, thereby avoiding the spring 200 from reaching and/or sitting in the unlocking groove 140. As shown in the cross-section view of FIG. 7, the unlocking groove 140 sits inside the open end 175 of the socket contact 165 and away from the spring 200. Once the electrical connector 100 is properly assembled, a seal grommet 210 (see FIG. 1) may be positioned over the connector junction and collar 150 (if used) to seal the electrical connector 100 from environmental conditions.

Figure 8:
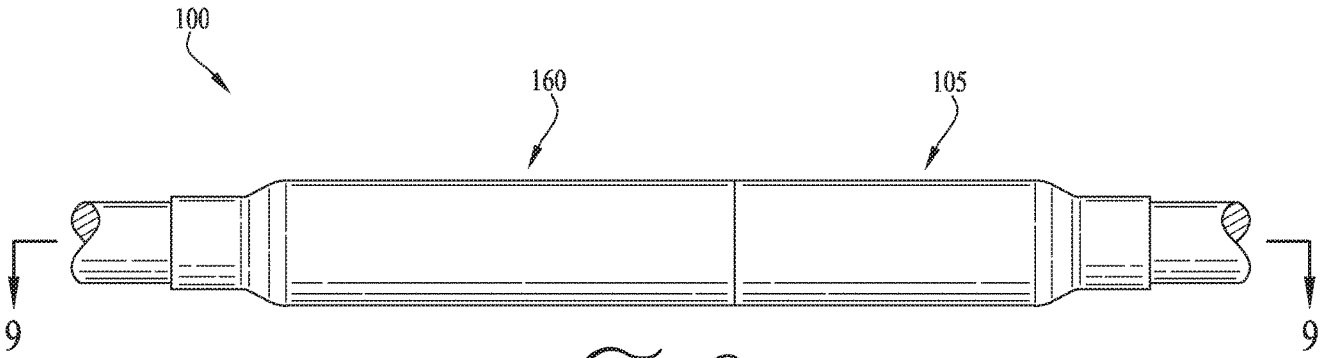
FIG. 8 is a side view of an embodiment of the electrical connector of FIG. 1 in a mated and unlocked configuration.
Figure 9:
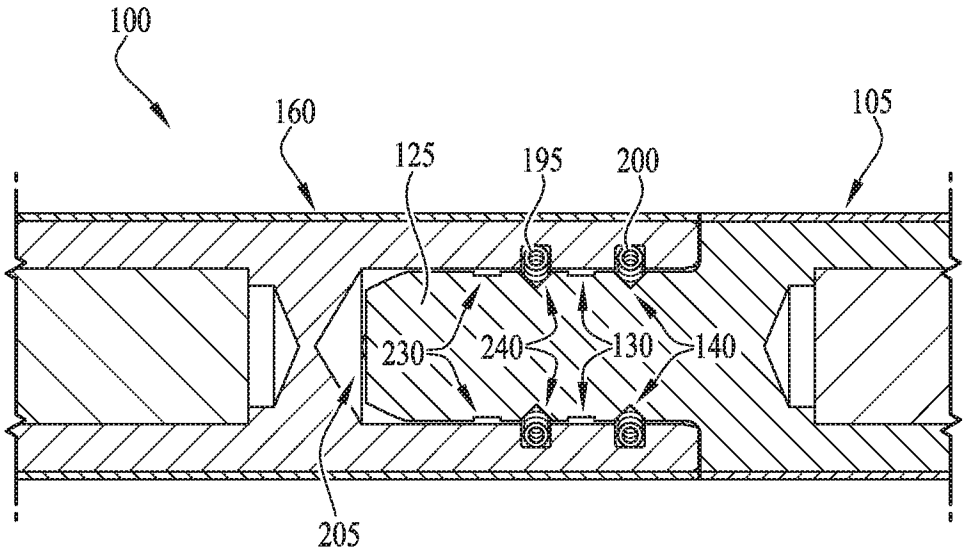
FIG. 9 is an enlarged cross-section view of a portion of the electrical connector of FIG. 8.

FIG. 8 illustrates a view of the electrical connector 100 in a mated and unlocked configuration, and FIG. 9 illustrates a cross-section view of a portion of the electrical connector 100 of FIG. 8. As noted previously, once the connectors 105, 160 are properly mated, the springs 195, 200 collectively resist decoupling of the electrical connector 100 unless a large removal force is applied to overcome the mechanical locking forces created by the springs 195, 200. While it may be possible to apply such force to manually decouple the connectors 105, 160 from one another, such force may damage the electrical connector 100 and/or its components. Accordingly, the electrical connector 100 has been designed to include unlocking features to more easily decouple the electrical connector 100 when desired as further described below.

With particular reference to FIG. 9, the seal grommet 210 (if applied) is first removed to expose the collar 150 (if used). Thereafter, the collar 150 is removed. Once the collar 150 has been removed, the pin connector 105 may be advanced further into the cavity 205 of the socket contact 165. While the springs 195, 200 may resist counter clockwise rotation within the channels 180, 190 and grooves 230,130, respectively, when attempting to decouple the electrical connector 100, the springs 195, 200 may continue rotating in the clockwise direction and allow the pin contact connector 105 to move further into the cavity 165 with relatively little force (e.g., 5-15 pounds). As the head portion 125 of the pin connector 105 advances into the cavity 205, the unlocking grooves 140, 240 on the head portion 125 approach the position of the springs 200, 195, respectively. Once the head portion 125 is sufficiently advanced into the cavity 205, the spring 200 aligns with the unlocking groove 140 and is seated therein, and the spring 195 aligns with the unlockin groove 240 and is seated therein. Since the unlocking grooves 140, 240 are generally wider and deeper as compared to the locking grooves 130, 230 the springs 195, 200 are provided sufficient space to rotate in the counter-clockwise direction and uncoil/decompress within the unlocking grooves 240, 140. As the springs 195, 200 uncoil, the springs 195, 200 no longer resist decoupling of the connectors 105, 160 to as high a degree as compared to when the springs 195, 200 were positioned in the locking grooves 230, 130. In some embodiments, the unlocking grooves 140, 240 have V-shaped configurations to put the load on a higher portion of the springs 195, 200 to cause the springs 195, 200 to flip and facilitate the decoupling process. Accordingly, the application of force needed to decouple the pin contact connector 105 and socket contact connector 160 is reduced to allow for an easier decoupling process with an application of approximately 5-15 pounds of force.

It should be understood that other embodiments than those described herein may be possible. For example, in other embodiments, the electrical connector may include additional springs, along with additional locking and unlocking grooves to adjust the insertion and removal force for the electrical connector. In addition, although the description above contains much specificity, these details should not be construed as limiting the scope of the invention, but as merely providing illustrations of some embodiments of the invention. It should be understood that subject matter disclosed in one portion herein can be combined with the subject matter of one or more of other portions herein as long as such combinations are not mutually exclusive or inoperable.

The terms and descriptions used above are set forth by way of illustration only and are not meant as limitations. It will be obvious to those having skill in the art that many changes may be made to the details of the above-described embodiments without departing from the underlying principles of the invention.

The invention claimed is:

1. An electrical connector system, comprising:

a first connector including an electrically conductive pin contact, the pin contact including a head portion projecting outwardly along an axial direction from a face of the first connector, wherein the head portion includes a first groove and a second groove each formed along a circumference thereof, wherein the first groove is formed at a first depth relative to an exterior surface of the head portion, and wherein the second groove is formed at a second depth relative to the exterior surface of the head portion, the first depth being shallower than the second depth, the head portion further including a third groove and a fourth groove each formed along a circumference thereof, wherein the third groove is adjacent the second groove and the fourth groove is adjacent the third groove and wherein the first groove and third groove are formed at substantially equal depths relative to one another, and wherein the second groove and fourth groove are formed at substantially equal depths relative to one another;

a second connector having a contact-receiving cavity extending in the axial direction and opening along a rear end of the second connector, wherein the second connector is configured to be mated to the first connector by sliding the connectors along the axial direction to insert the head portion of the pin contact into the contact-receiving cavity, and wherein the second connector further includes an interior wall forming a boundary of the contact-receiving cavity;

a first channel recessed inwardly relative to the interior wall of the second connector; and a first coiled spring seated within the first channel of the second connector, wherein, when the first and second connectors are mated in a locked configuration, the first coiled spring engages the first groove of the head portion of the pin contact to latch the first and second connectors together in a locked configuration.

2. The electrical connector system of claim 1, wherein the first connector further includes a shoulder portion, the electrical connector system further comprising a collar seated against the shoulder portion of the first connector, the collar contacting the rear end of the second connector to maintain the first and second connectors in the locked configuration.

3. The electrical connector system of claim 1, further comprising a seal grommet positioned at a junction between the first and second connectors to seal the electrical connector from environmental conditions.

4. The electrical connector system of claim 1, further comprising a second coiled spring seated within a second channel of the second connector, wherein the second coiled spring contacts the head portion of the pin contact to transfer electrical current between the first and second connectors when mated in the locked configuration.

5. The electrical connector system of claim 4, wherein a width of the first channel is substantially equal to a width of the second channel.

6. The electrical connector system of claim 1, wherein the first coiled spring and the second coil spring each rotate within the respective first and second channels and against the head portion of the pin contact as the head portion is advanced into the contact-receiving cavity.

7. The electrical connector system of claim 1, wherein the first and second connectors are movable from the locked configuration to an unlocked configuration by driving the head portion of the first connector into the contact-receiving cavity of the second connector, and wherein the first spring disengages from the first groove and engages the second groove of the head portion of the pin contact when the first and second connectors are in the unlocked configuration.

8. The electrical connector system of claim 1, wherein the second groove further includes an indicator marking formed thereon, the indicator marking indicating whether the first and second connectors are in the locked configuration.

9. An electrical connector comprising:

an electrically conductive pin contact, the pin contact including a head portion projecting outwardly along an axial direction from a face of the first connector;

a first groove formed along a circumference of the head portion at a first depth relative to an exterior surface of the head portion; and a second groove formed along the circumference of the head portion at a second depth relative to an exterior surface of the head portion, wherein the second groove further includes an indicator marking formed thereon, the indicator marking indicating when the first connector is in a locked configuration.

10. The electrical connector of claim 9, wherein the electrical connector further includes a shoulder portion formed adjacent the head portion, the electrical connector further comprising a collar seated against the shoulder portion.

11. The electrical connector of claim 9, wherein the first depth is shallower than the second depth, the electrical connector further comprising a third groove and a fourth groove each formed along a circumference of the head portion on an exterior surface of the head portion, wherein the third groove is adjacent the second groove and the fourth groove is adjacent the third groove, and wherein the first groove and third groove are formed at substantially equal depths relative to one another, and wherein the second groove and fourth groove are formed at substantial equal depths relative to one another.

12. An electrical connector system, comprising:

a first connector including an electrically conductive pin contact, the pin contact including a head portion projecting outwardly along an axial direction from a face of the first connector, wherein the head portion includes a first groove and a second groove each formed along a circumference thereof, and wherein one of the first groove or the second groove further includes an indicator marking formed thereon, the indicator marking indicating whether the first and second connectors are in a locked configuration;

a second connector having a contact-receiving cavity extending in the axial direction and opening along a rear end of the second connector, wherein the second connector is configured to be mated to the first connector by sliding the connectors along the axial direction to insert the head portion of the pin contact into the contact-receiving cavity, and wherein the second connector further includes an interior wall forming a boundary of the contact-receiving cavity;

a first channel recessed inwardly relative to the interior wall of the second connector; and a first coiled spring seated within the first channel of the second connector, wherein, when the first and second connectors are mated in the locked configuration, the first coiled spring engages the first groove of the head portion of the pin contact to latch the first and second connectors together in the locked configuration.

13. The electrical connector system of claim 12, wherein the first coiled spring and the second coiled spring area each made of an electrically conductive material.

14. The electrical connector system of claim 12, wherein the first connector further includes a shoulder portion, the electrical connector system further comprising a collar seated against the shoulder portion of the first connector, the collar contacting the rear end of the second connector to maintain the first and second connectors in the locked configuration.

15. The electrical connector system of claim 14, wherein one of the first coiled spring and the second coiled spring is made of copper, and the other of the first coiled spring and the second coiled spring is made of stainless steel.

16. The electrical connector system of claim 12, further comprising a seal grommet positioned at a junction between the first and second connectors to seal the electrical connector from environmental conditions.

17. The electrical connector system of claim 12, further comprising a second coiled spring seated within a second channel of the second connector, wherein the second coiled spring contacts the head portion of the pin contact to transfer electrical current between the first and second connectors when mated in the locked configuration.

18. The electrical connector system of claim 17, wherein a width of the first channel is substantially equal to a width of the second channel.

19. The electrical connector system of claim 12, wherein the first and second connectors are movable from the locked configuration to an unlocked configuration by driving the head portion of the first connector into the contact-receiving cavity of the second connector, and wherein the first spring disengages from the first groove and engages the second groove of the head portion of the pin contact when the first and second connectors are in the unlocked configuration.

20. The electrical connector system of claim 12, wherein the first groove is formed at a first depth relative to an exterior surface of the head portion, and wherein the second groove is formed at a second depth relative to the exterior surface of the head portion, the first depth being shallower than the second depth.

* * * * *